US006168090B1

(12) United States Patent
Baker

(10) Patent No.: US 6,168,090 B1
(45) Date of Patent: Jan. 2, 2001

(54) FLAME SPRAY SYSTEM WITH SPLATTER BLOCKING AND AUTOMATED ROD DELIVERY APPARATUSES

(76) Inventor: Edgar C. Baker, 949 Campbells Mill Rd., Blairsville, PA (US) 15717

( * ) Notice: Under 35 U.S.C. 154(b), the term of this patent shall be extended for 0 days.

(21) Appl. No.: 09/224,179

(22) Filed: Dec. 31, 1998

(51) Int. Cl.[7] ..... B05B 7/18
(52) U.S. Cl. ..... 239/84; 239/104; 239/120
(58) Field of Search ..... 239/82, 83, 84, 239/79, 104, 120–122; 141/81, 88

(56) References Cited

U.S. PATENT DOCUMENTS

| | | | |
|---|---|---|---|
| 3,632,952 | 1/1972 | Haulpauge et al. | 219/76 |
| 4,024,369 | 5/1977 | Thompson et al. | 219/76 |
| 4,047,564 * | 9/1977 | Bassendale | 141/1 R |
| 4,107,508 | 8/1978 | Izumi et al. | 219/137.7 |
| 4,325,512 | 4/1982 | Kenshol | 239/84 |
| 4,359,189 * | 11/1982 | Kroll et al. | 239/121 |
| 4,624,410 | 11/1986 | Rogers | 239/83 |
| 4,668,852 | 5/1987 | Fox et al. | 219/76.14 |
| 4,700,896 * | 10/1987 | Takeuchi et al. | 239/693 |
| 4,853,513 | 8/1989 | Fuimefreddo | 219/76.14 |
| 4,944,464 | 7/1990 | Zelenka | 242/54 R |
| 4,967,812 * | 11/1990 | Herzog | 141/88 |
| 4,992,337 | 2/1991 | Kaiser et al. | 428/642 |
| 5,191,186 | 3/1993 | Crapo, III et al. | 219/76.16 |
| 5,275,336 | 1/1994 | Stasi et al. | 239/84 |
| 5,449,118 | 9/1995 | Baker | 239/84 |

* cited by examiner

*Primary Examiner*—Andres Kashnikow
(74) *Attorney, Agent, or Firm*—Michael R. Swartz; John R. Flanagan

(57) ABSTRACT

A flame spray system employs splatter blocking and automated rod delivery apparatuses. The splatter blocking apparatus includes a barrier member and an actuation mechanism. The barrier member is adapted to be moved between a blocking position in which the barrier member is extended across a spray path from a flame spray gun of a flame spray system preventing travel of particles of fusible material from the flame spray gun to a product being coated and an unblocking position in which the barrier member is displaced from the spray path of the flame spray gun permitting travel of particles fusible material from the flame spray gun to the product being coated. The actuation mechanism is connected to the barrier member and adapted to be selectively actuated to move the barrier member between the blocking and unblocking positions. The automated rod delivery apparatus includes a magazine having a chamber for holding a plurality of the rods of heat fusible material in a stacked relationship with one another and a feed mechanism adjacent to the magazine and adapted to be selectively actuated to successively engage and transfer a lowermost one of the rods from the stack thereof in the chamber of the magazine out through a front opening of the magazine and into a feed passage of the flame spray gun.

35 Claims, 7 Drawing Sheets

24
26
X
Y
84
T
B
78
46
16

FLAME SPRAY SYSTEM WITH SPLATTER BLOCKING AND AUTOMATED ROD DELIVERY APPARATUSES

BACKGROUND OF THE INVENTION

1. Field of the Invention

The present invention generally relates to thermal or flame spraying and, more particularly, is concerned with a flame spray system employing splatter blocking and automated rod delivery apparatuses.

2. Description of the Prior Art

Thermal spraying, also known as flame spraying, is a system that involves the heat softening of a heat fusible material, such as metal or ceramic, and propelling the softened material in particulate or droplet form against a surface which is to be coated. The heated particles strike the surface where they are quenched and bonded to the surface to form a protective coating thereon. A thermal or flame spray gun is typically used for both heating and propelling the particles.

In the flame spray gun disclosed in U.S. Pat. No. 4,325,512 to Kenshol, the heat fusible material in rod form is fed into a combustion head by a pair of feed rolls driven by an air-driven turbine or motor. The leading tip of the rod of heat fusible material is softened and melted by a flame in the combustion head and is atomized by an atomizing blast gas, such as compressed air, delivered to a spray head. The atomized material in finely divided particles or droplets is propelled from the spray head by the blast gas onto a surface to be coated. The spray head includes a spray nozzle and a gas cap for providing an annular flame around the axially fed rod of heat fusible material.

Several problems were experienced with the flame spray gun of the above-cited Kenshol patent which arose from the use of the air-driven motor and resulted in production of a coating of poor quality. The problems related to the introduction of contaminants with the air drawn in by the air-driven turbine and the variation in the rate of feeding of the rod of heat fusible material, and thus variation in rate of atomization of the rod, due to the inability to effectively control the volume and pressure of the air used to drive the motor. These problems were successfully overcome by the feed rate control apparatus disclosed in U.S. Pat. No. 5,449,118 to Baker wherein an electric motor was provided to replace the air-driven motor and other components were provided for controlling the operation of the electric motor and thereby precisely controlling the rate of feeding of the rod of heat fusible material through the flame spray gun and the rate of atomizing of the rod into particles of heat fusible material.

However, after an extended period of experience with the operation of the flame spray system employing the feed rate control apparatus of the above-cited Baker patent, the inventor herein and also of the patented feed rate control apparatus has encountered an additional problem that was not addressed by the feed rate control apparatus of the Baker patent. This problem is a recurring interruption in the uniform and steady feeding of rods through the feed rollers of the flame spray gun due to manually feeding of rods and to a gap that always exists between trailing and leading ends of successively fed rods. This interruption results in periodic splattering of the particles of heat fusible material rather than a uniform spray. Up to the present time, the operator has had to manually place a flag in front of the spray nozzle of the flame spray gun during this feed interruption period to prevent the splattered material from reaching the product being coated.

Consequently, a need exists for further improvement of the flame spray system to solve the newly encountered problems without introduction of other problems in place thereof.

SUMMARY OF THE INVENTION

The present invention provides a flame spray system with splatter blocking and automated rod delivery apparatuses designed to satisfy the aforementioned needs. The splatter blocking apparatus provides for the avoidance of splattering, as opposed to spraying, of particles of heat fusible material from a flame spray gun onto a product being coated. The automated rod delivery apparatus provides for the feeding of the rods of heat fusible material through the flame spray gun in a substantially automatic, as opposed to manual, mode that achieves a more consistent, steady and controlled feeding of the rods and thereby a more uniform spraying of the heat fusible material particles onto the product being coated.

Accordingly, the present invention is directed to a splatter blocking apparatus for use in a flame spray system. The splatter blocking apparatus comprises: (a) a barrier member adapted to be moved between a blocking position in which the barrier member is extended across a spray path from a flame spray gun of a flame spray system preventing travel of particles of fusible material from the flame spray gun to a product being coated and an unblocking position in which the barrier member is displaced from the spray path of the flame spray gun permitting travel of particles fusible material from the flame spray gun to the product being coated; and (b) an actuation mechanism connected to the barrier member and adapted to be selectively actuated to move the barrier member between the blocking and unblocking positions. The actuation mechanism includes a stationary member mounted in a stationary position alongside the flame spray gun and having a longitudinal axis and a guide element extending along and in an arcuate path at least partially about the axis, and a movable member mounted to the stationary member to undergo axial movement relative to the stationary member along the axis of the stationary member. The movable member has a follower element engaged with the guide element of the stationary member such that the axial movement of the movable member along the axis of the stationary member between forward and rearward positions relative to the stationary member causes corresponding rotational movement of the movable member between first and second positions relative to the stationary member. The barrier member is mounted on the movable member forwardly of the stationary member to undergo movement with the movable member. The barrier member is moved to the blocking position upon axial movement of the movable member to the forward position and rotational movement of the movable member to the first position. The barrier member is moved to the unblocking position upon axial movement of the movable member to the rearward position and rotational movement of the movable member to the second position. The actuation mechanism further includes an actuator coupled to the movable member and being operable to cause the axial movement of the movable member between the forward and rearward positions relative to the stationary member.

More particularly, the stationary member is an elongated hollow sleeve having a pair of opposite ends. The guide element is a slot defined in the hollow sleeve extending along and in an arcuate path at least partially about the longitudinal axis of the sleeve. The movable member is an elongated support rod extending through the hollow sleeve and being greater in length than the hollow sleeve such that opposite ends of the support rod extend beyond opposite ends of the hollow sleeve. The follower element is a protrusion on the support rod extending outwardly into the slot of the sleeve such that the axial movement of the support rod between forward and rearward positions causes corresponding rotational movement of the support rod between first and second positions. The barrier member is a flag. The actuator is coupled to the support rod rearwardly of the sleeve.

The present invention also is directed to an automated rod delivery apparatus for use in a flame spray system which comprises: (a) a magazine having a chamber for holding a plurality of elongated rods of heat fusible material in a stacked relationship with one another, the magazine having a front opening aligned with a lowermost one of the rods in the stack thereof in the chamber of the magazine and also aligned with a feed passage through a flame spray gun leading to a combustion head in the flame spray gun wherein the rod is advanced toward the combustion head and progressively soften and atomized into particles of fusible material; and (b) a feed mechanism mounted adjacent to the magazine and adapted to be selectively actuated to successively engage and transfer the lowermost one of the rods from the stack thereof in the chamber of the magazine out through the front opening of the magazine and into the feed passage of the flame spray gun.

More particularly, the magazine includes an enclosure having a stationary sidewall portion and a movable sidewall portion facing the stationary sidewall portion and being movable toward and away therefrom and therewith defining the chamber therebetween. The magazine further includes means for adjustable moving the movable sidewall portion toward and away from the stationary sidewall portion so as to adjust the chamber in width to receive rods of different diameters therein. The feed mechanism includes a feed rod inserted into the chamber of the magazine through a rear opening thereof in alignment with the lowermost one of the rods of heat fusible material therein and an actuator connected to the feed rod and being operable to cause the feed rod to successively engage and transfer the lowermost one of the rods from the stack thereof in the chamber of the magazine out through the front opening of the magazine and into the feed passage of the flame spray gun. The feed rod has a leading nose end with an inclined or wedge-shaped configuration adapting the feed rod to push forward on the lowermost one of the rods as the feed rod raises the remainder of the rods in the stack thereof upwardly out of the way of the lowermost rod.

The present invention further is directed to a flame spray system which comprises: (a) a flame spray gun adapted to receive a rod of heat fusible material therethrough and to progressively soften and atomize the rod into fusible material particles and to spray the particles onto a product to be coated; (b) means for controlling the rate of feeding of the rod of heat fusible material through the flame spray gun; (c) the splatter blocking apparatus as defined above being adapted to be selectively actuated in timed relationship with interruption in feeding of rods through the flame spray gun for avoidance of splattering of particles of heat fusible material from the flame spray gun onto a product being coated; and (d) the automated rod delivery apparatus as defined above being adapted to store a stack of rods of heat fusible material and to be selectively actuated to successively engage and transfer a lowermost one of the rods from the stack thereof into the flame spray gun.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 5:
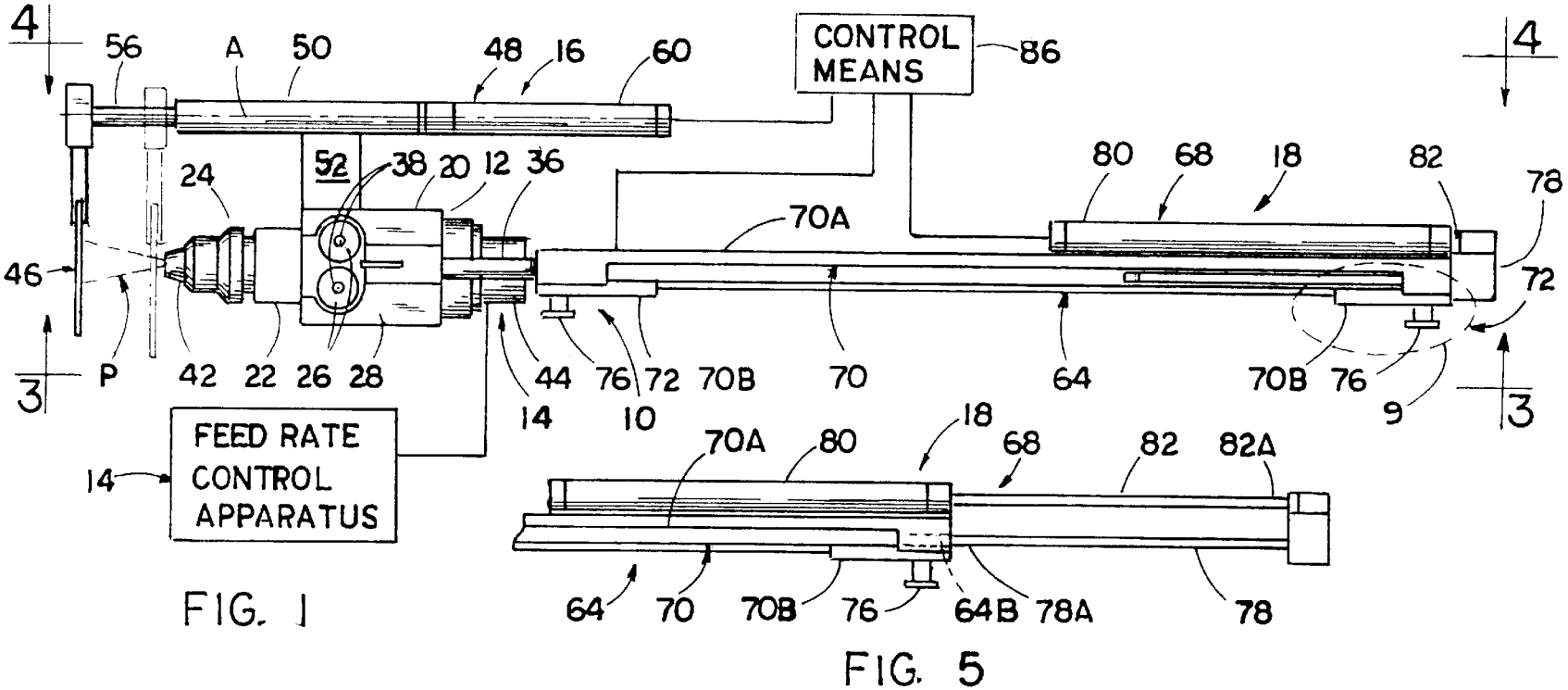
FIG. 1 is a top plan view of a flame spray system having splatter blocking and automated rod delivery apparatuses both of the present invention in conjunction with a flame spray gun and a feed rate control apparatus both of the prior art.
FIG. 5 is a fragmentary side elevational view of the automated rod delivery apparatus of the system with an actuator of the apparatus being shown in an extended position as opposed to a retracted position shown in FIG. 1.
Figure 2:
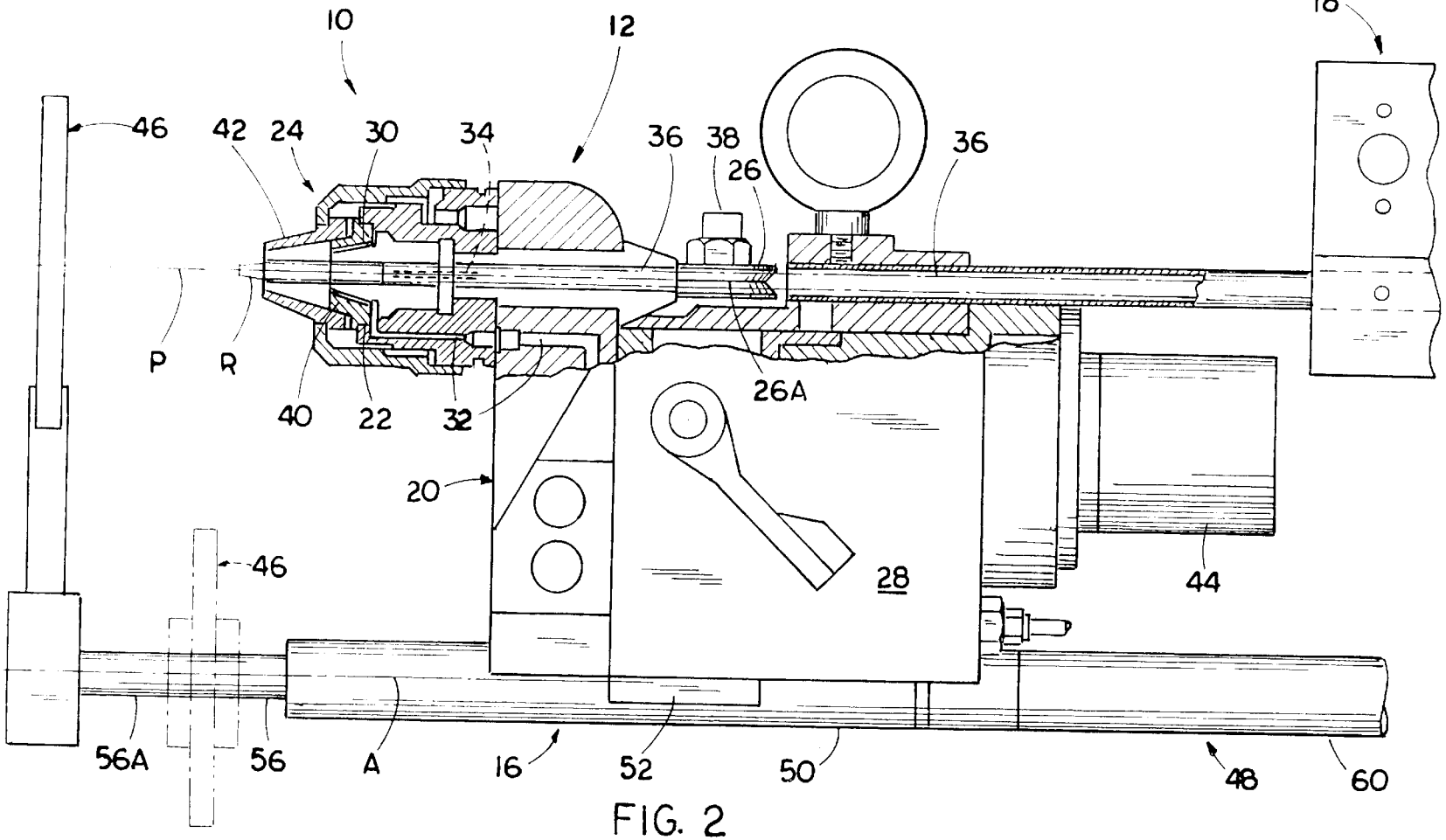
FIG. 2 is an enlarged side elevational view of the flame spray system showing only the splatter blocking apparatus with the flame spray gun.
Figure 3:
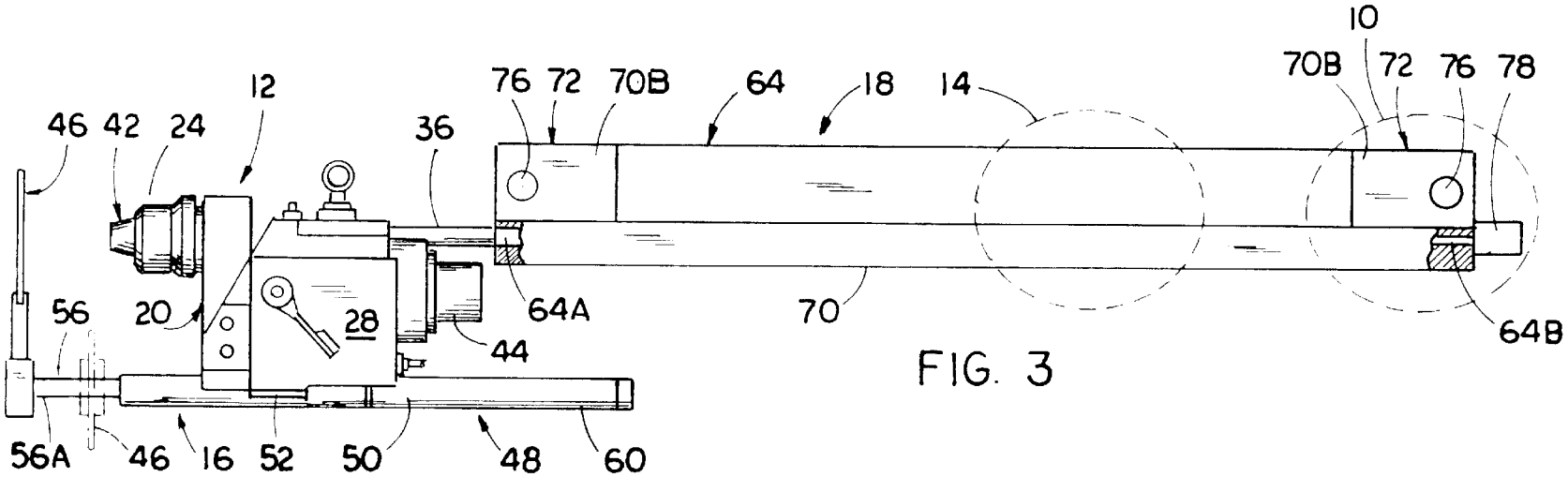
FIG. 3 is a side elevational view of the flame spray system as seen along line 3—3 of FIG.1.
Figure 3A:
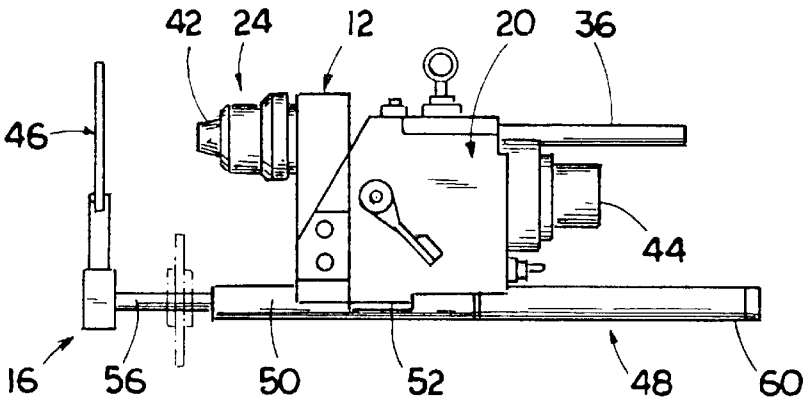
FIG. 3A is a side elevational view of the flame spray system similar to that of FIG. 3 but without the automated rod delivery apparatus.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

In General

Referring to the drawings and particularly to FIGS. 1 to 4, there is illustrated a flame spray system of the present invention, being generally designated 10. The flame spray system 10 of the present invention basically includes a flame spray gun 12, a feed rate control apparatus 14, a splatter blocking apparatus 16, and an automated rod delivery apparatus 18. The flame spray gun 12 is generally the same as the one illustrated and described in aforesaid U.S. Pat. Nos. 4,325,512 and 5,449,118 (the disclosures of which are incorporated herein by reference thereto) and the feed rate control apparatus 14 employed with the flame spray gun 12 is generally the same as the one illustrated and described in aforesaid U.S. Pat. No. 5,449,118 (the disclosure of which is incorporated herein by reference thereto). The splatter blocking apparatus 16 and the automated rod delivery apparatus 18 are the new features of the frame spray system 10 which individually and in combination constitute the present invention and so are described in detail hereinafter. Only those parts of the flame spray gun 12 and feed rate control apparatus 14 that are necessary to facilitate a complete understanding of these new features of the flame spray system 10 will be described hereinafter.

Referring to FIGS. 1 to 4, the flame spray gun 12 of the flame spray system 10 includes a gun body 20, a combustion head 22 on the gun body 20, a spray head 24 extending from the combustion head 22, a pair of feed rolls 26, and a gear train 28 drivingly coupled to the feed rolls 26. The gun body 20 also has respective air, fuel and oxidant flow passages 30, 32, 34 defined therein which lead from the exterior of the gun body 20 through the interior thereof to the combustion head 22 for supplying the constituents necessary to support combustion and generation of a flame in the combustion head 22. Also, a feed passage 36 is provided through the gun body 20 for guiding a rod R of heat fusible material from the exterior of the gun body 20 through the interior thereof between and past the pair of feed rolls 26 and into the combustion head 22. The feed rolls 26 mounted on rotary output shafts 38 of the gear train 28 have annular V-grooves 26A which receive the rod R therebetween and are provided in frictional engagement with opposite sides of the rod R.

The leading tip of the rod R of heat fusible material is softened and melted by a flame in the combustion head 22 and is atomized by an atomizing blast gas, such as compressed air, delivered to the spray head 24. The atomized material in finely divided particles or droplets is propelled from the spray head 24 by the blast gas onto a surface of a product to be coated. The spray head 24 includes a spray nozzle 40 and a gas cap 42 for providing an annular flame around the axially fed rod R of heat fusible material as it is fed into the combustion head 22 of the spray body 20. The material making up the rod R can be a variety of suitable materials. One such material is a suitable ceramic.

The feed rate control apparatus 14 of the flame spray system 10 includes an electric motor 44 having an rotary output shaft (not shown) drivingly coupled to the gear train 28. The electric motor 44 is operable in response to application of a D.C. voltage thereto by other components (not shown) of the feed rate control apparatus 14 to generate rotary motion at its output shaft which via the gear train 28 causes rotation of the feed rolls 26 and thereby produces and controls feeding of the rod R of heat fusible material by the feed rolls 26 advancing the rod R through the feed passage 36 of the gun body 20 to the combustion head 22 thereof.

Splatter Blocking Apparatus

Referring to FIGS. 1 to 4 and 6 to 8, there is illustrated the splatter blocking apparatus 16 of the flame spray system 10. The splatter blocking apparatus 16 is adapted to be selectively actuated for avoidance of splattering of particles of heat fusible material from the flame spray gun 12 onto a product being coated which would otherwise normally always occur during the interval of time spanning completion of atomizing of one rod R and initiation of atomizing of a succeeding rod R.

The splatter blocking apparatus 16 basically includes a barrier member preferably in the form of a flag 46 and an actuation mechanism 48. The flag 46 is adapted to be moved between a blocking position, as shown in solid line form in FIGS. 1 to 4 and 6, in which the flag 46 is extended across a spray path P from the flame spray gun 12 preventing the travel of particles of fusible material from the flame spray gun 12 to the product being coated and an unblocking position, as shown in dashed line form in FIGS. 1 to 3A and 6, in which the flag 46 is rotated and displaced from the spray path P of the flame spray gun 12 permitting travel of particles of fusible material from the flame spray gun 12 to the product being coated.

The actuation mechanism 48 of the splatter blocking apparatus 16 is connected to the flag 46 and adapted to be selectively actuated to move the flag 46 between the blocking and unblocking positions. More particularly, the actuation mechanism 48 includes a stationary member preferably in the form of a stationary hollow sleeve 50 mounted by a bracket 52 from the flame spray gun 12 and disposed in a stationary position alongside the flame spray gun 12. The stationary hollow sleeve 50 has a longitudinal axis A and a guide element preferably in the form of a guide slot 54 extending along and in an arcuate path at least partially about the axis A. The actuation mechanism 48 also includes a movable member preferably in the form of a support rod 56 movably mounted through the stationary hollow sleeve 50 to undergo axial movement relative thereto along the axis A thereof.

The support rod 56 has a follower element preferably in the form of a protrusion or pin 58 protruding outwardly from the support rod 56 and into the guide slot 54 of the hollow sleeve 50. Axial movement of the support rod 56 along the axis A of the hollow sleeve 50 between rearward and forward positions relative to the stationary hollow sleeve 50, as respectively shown in dashed and solid line forms in FIG. 7, moves the pin 58 along the arcuate slot 54 from the dashed line position to solid line position in FIG. 7 and thereby causes corresponding rotational movement of the support rod 56 between first and second positions relative to the stationary hollow sleeve 50. The support rod 56 is greater in length than the hollow sleeve 50 such that opposite front and rear ends 56A, 56B of the support rod 56 extend beyond opposite front and rear ends 50A, 50B of the hollow sleeve 50.

The flag 46 is mounted on the front end 56A of the support rod 56 forwardly of the front end 50A of the stationary hollow sleeve 50 to undergo movement with the support rod 56. The flag 46 is moved to the blocking position shown in solid line form in FIG. 6 upon axial movement of the support rod 56 to the forward position and rotational movement of the support rod 56 to the first position shown in solid line forms in FIGS. 6 and 7. In the blocking position, the flag 46 is aligned with the spray nozzle 40 of the flame spray gun 12 and thereby across the spray path P of the gun 12. The flag 46 is moved to the unblocking position shown in dashed line form in FIG. 6 upon axial movement of the support rod 56 to the rearward position and rotational movement of the support rod 56 to the second position shown in dashed line forms in FIGS. 6 and 7. In the unblocking position, the flag 46 is offset or displaced from the spray path P of the gun 12.

The actuation mechanism 48 further includes an actuator preferably in the form of a first air cylinder 60 having an end 62A of an extendable and retractable piston rod 62 of the air cylinder 60 coupled to the rear end 56B of the support rod 56 rearwardly of a rear end 50B of the hollow sleeve 50. The first air cylinder 60 is operable to cause axial movement of the support rod 56 between the forward and rearward positions relative to the stationary hollow sleeve 50.

Automated Rod Delivery Apparatus

Referring to FIGS. 1 to 3, 4, 5 and 9 to 21, there is illustrated the automated rod delivery apparatus 18 of the flame spray system 10. The automated rod delivery apparatus 18 provides for the feeding of the rods R of heat fusible material through the flame spray gun 12 in a substantially automatic, as opposed to manual, mode that achieves a more consistent, steady and controlled feeding of the rods R and thereby a more uniform spraying of the particules of heat fusible material onto the product being coated. The automated rod delivery apparatus 18 is particularly adapted to store a stack S of the rods R of heat fusible material and to be selectively actuated to successively engage and transfer a lowermost one of the rods L from the stack S into the flame spray gun 12.

The automated rod delivery apparatus 18 basically includes a magazine 64 having a chamber 66 for holding a plurality of elongated rods R of heat fusible material in a stacked relationship with one another, and a feed mechanism 68 for causing successive transfer of the rods R from the magazine 64 to the flame spray gun 12. The magazine 64 has a front opening 64A aligned with the lowermost one L of the rods R in the stack S thereof in the chamber 66 of the magazine 64. The front opening 64A of the magazine 64 also is aligned with the feed passage 36 through the flame spray gun 12 leading to the combustion head 22 in the flame spray gun 12 wherein the rod R is advanced toward the combustion head 22 by the feed rolls 26 of the gun 12 and at the combustion head 22 then progressively soften and atomized into particles of fusible material.

More particularly, the magazine 64 of the automated rod delivery apparatus 18 includes an enclosure 70 having a stationary sidewall portion 70A and a movable sidewall portion 70B facing the stationary sidewall portion 70A and being movable toward and away therefrom. Together, the opposing sidewall portions 70A, 70B define the effective width of the chamber 66. The magazine 64 further includes means 72 for adjustably moving the movable sidewall portion 70B toward and away from the stationary sidewall portion 70A so as to adjust the width of the chamber 66 to receive rods R of different diameters therein. The adjustable means 72 includes forward and rearward pairs of pins 74 mounted to the enclosure 70 and movably supporting the movable sidewall portion 70B and a spring-biased rotatable knob 76 associated with each pair of pins 74. Selected rotation of the knobs 76 cause movement of the movable sidewall portion 70B on the pairs of pins 74 toward and away from the stationary sidewall portion 70A of the enclosure 70.

The feed mechanism 68 of the automated rod delivery apparatus 18 is mounted adjacent to the magazine 64 and adapted to be selectively actuated to successively engage and transfer the lowermost one L of the rods R from the stack S thereof in the chamber 66 of the magazine 64 out through the front opening 64A of the magazine 64 and into the feed passage 36 of the flame spray gun 12. More particularly, the feed mechanism 68 includes an elongated feed rod 78 and an actuator in the form of a second air cylinder 80. The feed rod 78 is inserted into the chamber 66 of the magazine 64 through the rear opening 64B thereof in alignment with the lowermost one L of the stack S of rods R of heat fusible material therein. The second air cylinder 80 has an extendible and retractable piston rod 82 with an end 82A coupled to a rear end of the feed rod 78. The second air cylinder 80 is operable to axially move the feed rod 78 between the forward and rearward positions, respectively shown in FIGS. 1 and 5, relative to the magazine 64 and thereby cause the feed rod 78 to successively engage and transfer the lowermost one L of the rods R from the stack S thereof in the chamber 66 of the magazine 64 out through the front opening 64A of the magazine 64 and into the feed passage 36 of the flame spray gun 12.

Figure 4:
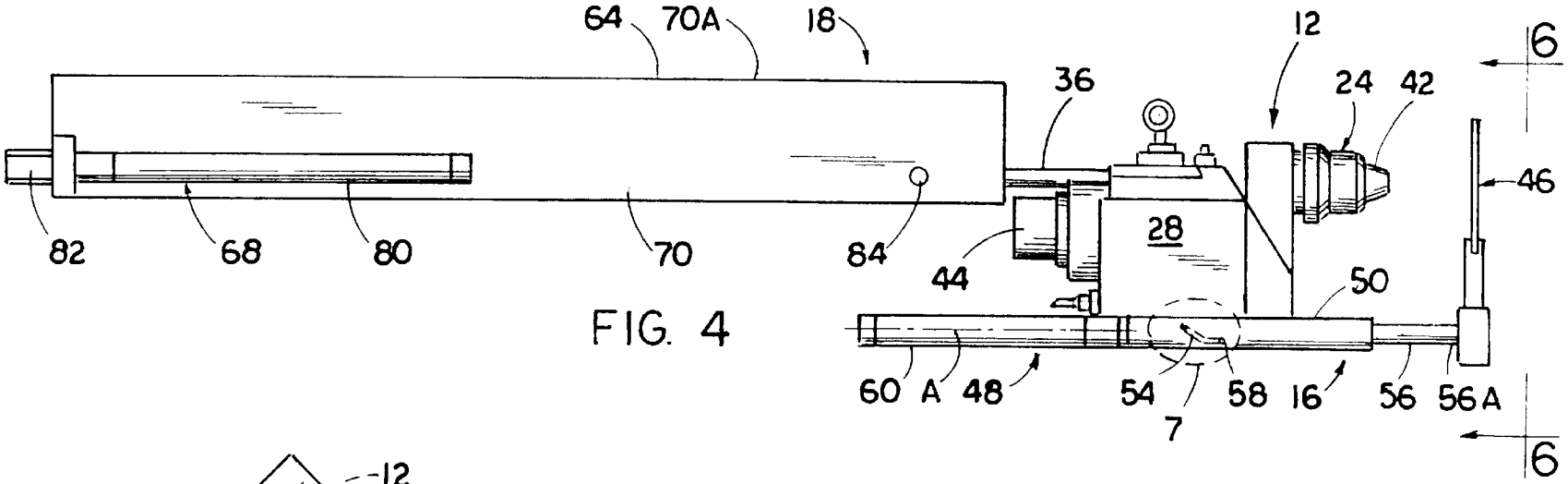
FIG. 4 is an opposite side elevational view of the flame spray system as seen along line 4—4 of FIG. 1.
Figure 8:
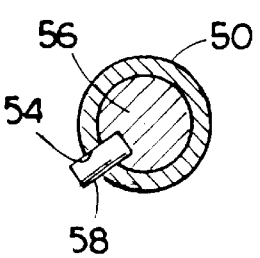
FIG. 8 is a cross-sectional view of the splatter blocking apparatus taken along line 8—8 of FIG. 7.
Figure 7:
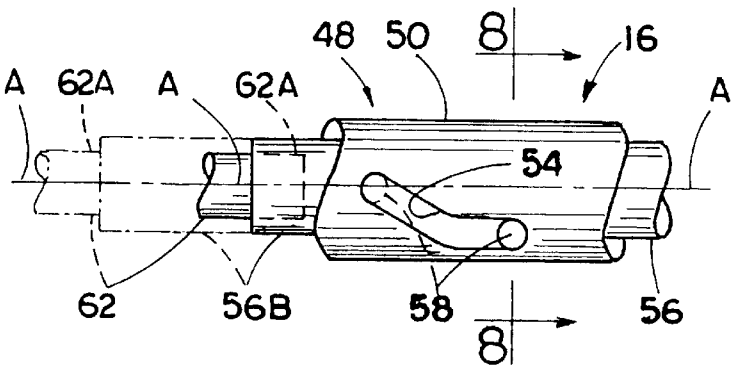
FIG. 7 is an enlarged detailed view of the portion of the splatter blocking apparatus enclosed by oval 7 in FIG. 4.
Figure 6:
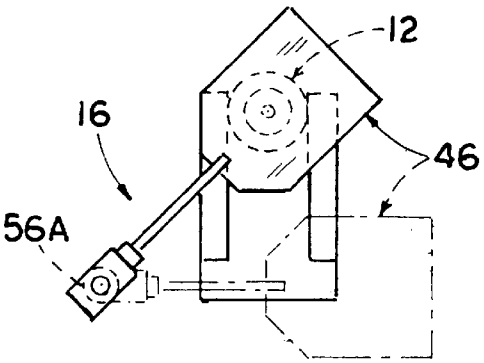
FIG. 6 is an end elevational view of the splatter blocking apparatus as seen along line 6—6 of FIG. 4.
Figure 15:
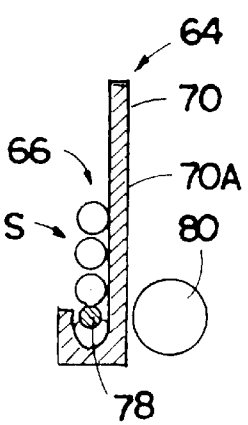
FIG. 15 is a cross-sectional view of the automated rod delivery apparatus taken along line 15—15 of FIG. 14.
Figure 14:
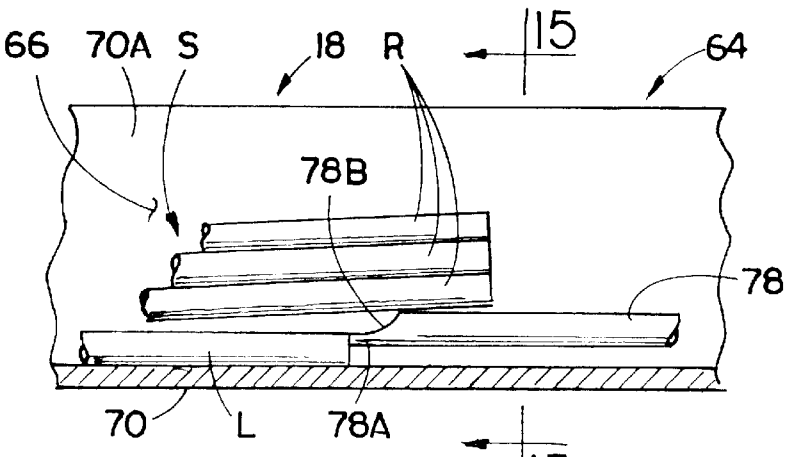
FIG. 14 is an enlarged detailed view of the portion of the automated rod delivery apparatus enclosed by oval 14 in FIG. 3.
Figure 12:
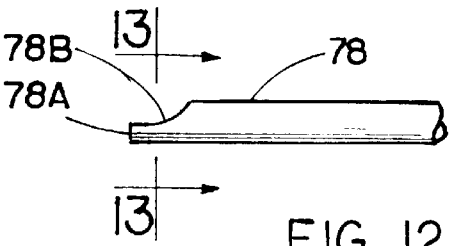
FIG. 12 is an enlarged fragmentary view of a push rod of the automated rod delivery apparatus showing an inclined or wedge shaped nose on a leading end of the push rod.
Figure 13:
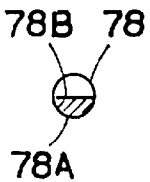
FIG. 13 is a cross-sectional view of the push rod taken along line 13—13 of FIG. 12.
Figure 11:
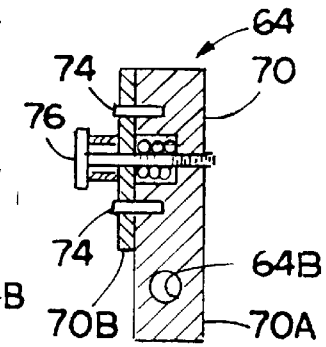
FIG. 11 is a cross-sectional view of the automated rod delivery apparatus taken along line 11—11 of FIG. 10.
Figure 9:
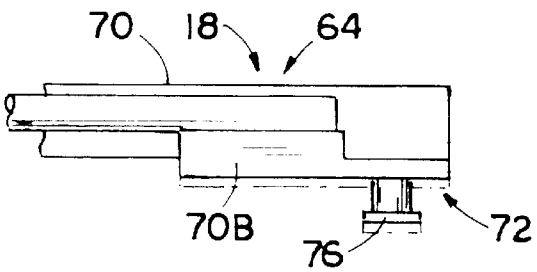
FIG. 9 is an enlarged detailed view of the portion of the automated rod delivery apparatus enclosed by oval 9 in FIG. 1.
Figure 10:
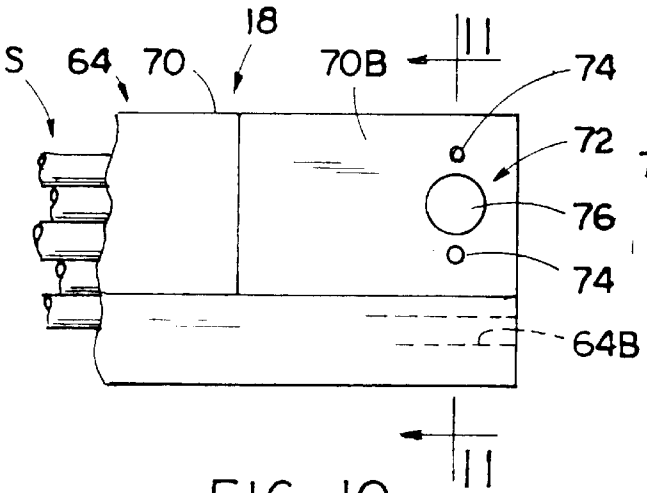
FIG. 10 is an enlarged detailed view of the portion of the automated rod delivery apparatus enclosed by oval 10 in FIG. 3.

As shown in FIGS. 12 to 14, the feed rod 78 has a leading nose end 78A with an inclined top wall 78B or wedge-shaped configuration adapting the leading end 78A of the feed rod 78 to push forward the lowermost one L of the rods R as the leading end 78A of the feed rod 78 raises the remainder of the rods R in the stack S thereof upwardly out of the way of the lowermost rod L. Also, as seen in FIG. 4, a rod position sensor means 84, such as photo type sensors, is placed in the stationary sidewall portion 70A of the enclosure 70 near the front end thereof and at a distance from the rear end of the enclosure 70 slightly greater than the length of the rod R. The sensor means 84 detects passing of the trailing end of the rod R being advanced by the feed rolls 26 through the flame spray gun 12 and provides an electrical signal which can be used to actuate the second air cylinder 80.

Figures 16, 17, 18, 19, 20, 21:
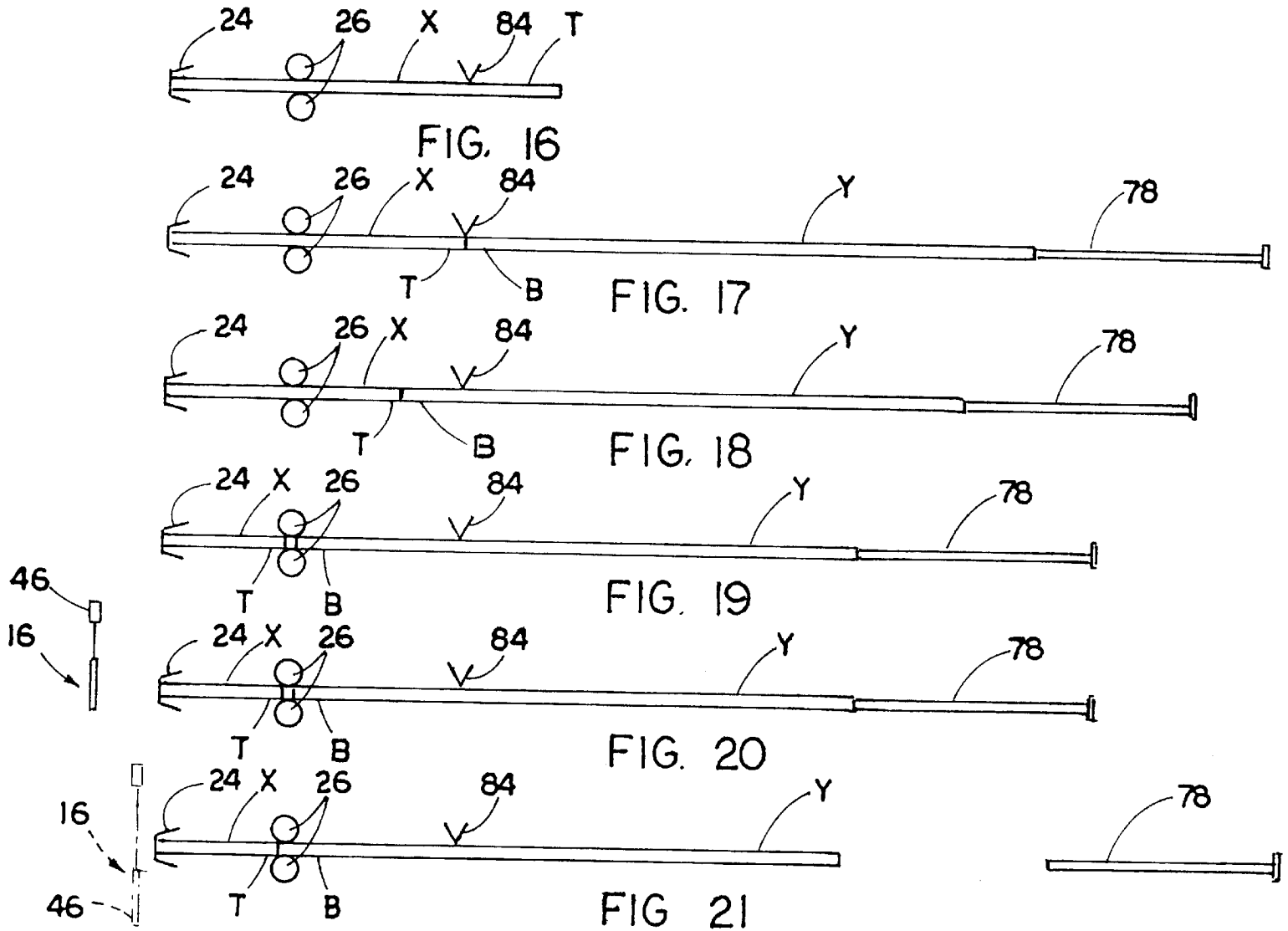
FIGS. 16 to 21 are a sequence of diagrammatic views showing successive positions of the push rod of the automated rod delivery apparatus in delivering a succeeding rod of heat fusible material through the flame spray gun.

Referring to FIGS. 16 to 21, there is diagrammatically depicted the successive positions of the feed rod 78 of the feed mechanism 68 of the automated rod delivery apparatus 18 in delivering each succeeding rod R of heat fusible material through the flame spray gun 12. FIG. 16 depicts a first rod X being moved by and between feed rolls 26 of the gun 12 to the spray head 24 thereof where the material of the first rod X is atomized and sprayed in particle form onto a product being coated.

FIG. 17 shows the trailing end T of the first rod X reaching the location of the sensor means 84 and a second rod Y falling into position between the first rod X and the feed rod 78 which is disposed at its rearward position. The sensor means 84 generates an electrical signal which will ultimately be employed to actuate the feed mechanism 68 of the automated rod delivery apparatus 18 to move the feed rod 78 along a forward stroke toward its forward position of FIG. 19 and also after a time delay to actuate the actuation mechanism 48 of the splatter blocking apparatus 16 to swing the flag 46 in front of the spray head 24 and deflect the atomized particles away from the product being coated. FIG. 18 depicts the feed rod 78 having partially completed its forward stroke.

FIG. 19 illustrates the feed rod 78 having fully completed its forward stroke to the forward position bringing the leading end B of the second rod Y between the feed rolls 26 just as the trailing end T of the first rod X has passed the feed rolls 26. FIG. 20 shows the actuation mechanism 48 of the splatter blocking apparatus 16 having operated at the end of the time delay to swing the flag 46 into the blocking position in front of the spray head 24 for a sufficient time to allow the second rod Y to engage the first rod X and push it forward through the spray head 24 of the gun 12. FIG. 21 depicts the feed rod 78 having fully completed its rearward or return stroke to its rearward position ready to repeat its forward stroke again. Also the actuation mechanism 48 having operated at the end of another time delay to swing the flag 46 back to the unblocking position away from the spray head 24 of the gun 12.

Figure 22:
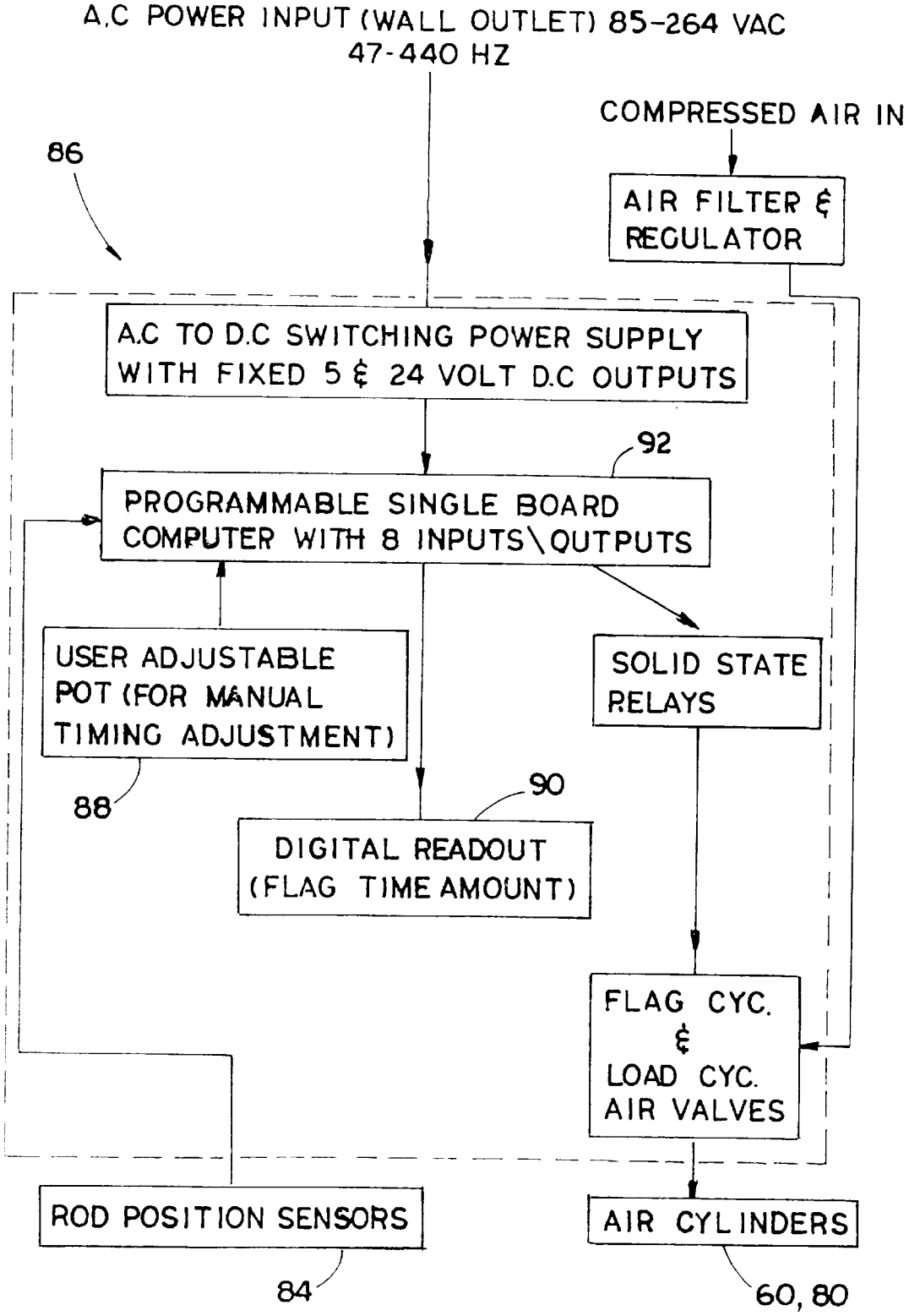
FIG. 22 is a block diagram of components for controlling the operations of the splatter blocking and automated rod delivery apparatuses.

FIG. 22 is a diagram of one exemplary arrangement of the components making up a computer-based control means, generally designated 86, for controlling the operations of the splatter blocking and automated rod delivery apparatuses 16, 18 of the present invention. The computer-based control means 86 has a manual mode and an automatic mode.

In the automatic mode of control means 86, the operator adjusts a potentiometer 88 fully counterclockwise. A display 90 will read auto mode. A first sensor of the sensor means 84 detects the end of the first rod X and sends a signal to the computer 92 to start timing. Next, a second sensor of the sensor means 84 detects the end of the first rod X and stops timing. Now, the computer 92 makes a calculation to determine the rod feed speed and the remaining length of the first rod X. This calculation is now used for flag time and a timing count down begins. At the end of timing, the flag or first air cylinder 60 is activated for five seconds. The flag 46 deflects the improper flow of spray away from the product being coated. This process is repeated until the rod magazine 64 is emptied or the spray process is stopped.

In the manual mode of the control means 86, the operator adjusts the potentiometer 88 clockwise to a desired flag time setting. After the second sensor of the sensor means 84 detects the end of the first rod X, the flag timing begins. At this time, the second air cylinder 80 of the feed mechanism 68 is activated for five seconds which moves its feed rod 78 to the rearward position so that the second rod Y can drop into the lower portion of the chamber 66 of the magazine 64 aligned between the front and rear openings 64A, 64B thereof. At the end of the five seconds, the flag or first air cylinder 60 is activated for a second five seconds. The flag 64 deflects the improper splatter away from the product being coated. This process is repeated until the rod magazine 64 is emptied or the spray process is stopped.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A splatter blocking apparatus for use in a flame spray system, said apparatus comprising:

(a) a barrier member adapted to be moved between a blocking position in which said barrier member is extended across a spray path from a flame spray gun of a flame spray system preventing travel of particles of fusible material from the flame spray gun to a product being coated and an unblocking position in which said barrier member is displaced from the spray path of the flame spray gun permitting travel of particles of fusible material from the flame spray gun to the product being coated; and (b) an actuation mechanism connected to said barrier member and adapted to be selectively actuated to move said barrier member between said blocking and unblocking positions, said actuation mechanism including (i) a stationary member mounted in a stationary position alongside the flame spray gun and having a longitudinal axis and a guide element extending along and in an arcuate path at least partially about said axis; and (ii) a movable member mounted to said stationary member to undergo axial movement between forward and rearward axial positions relative to said stationary member along said axis of said stationary member, said movable member having a follower element engaged with said guide element of said stationary member such that upon axial movement of said movable member between said forward and rearward axial positions, said follower element moves along said arcuate path of said guide element in thereby causing corresponding rotational movement of said movable member between first and second rotational positions relative to said stationary member.

2. The apparatus of claim 1, wherein said barrier member is mounted on said movable member forwardly of said stationary member to undergo movement with said movable member, said barrier member being moved to said blocking position upon axial movement of said movable member to said forward axial position and rotational movement of said movable member to said first rotational position, said barrier member being movable to said unblocking position upon axial movement of said movable member to said rearward axial position and rotational movement of said movable member to said second rotational position.

3. The apparatus of claim 1, wherein said actuation mechanism further includes an actuator coupled to said movable member and being operable to cause said axial movement of said movable member between said forward and rearward axial positions relative to said stationary member.

4. A splatter blocking apparatus for use in a flame spray system, said apparatus comprising:

(a) a stationary member mounted in a stationary position alongside a flame spray gun of said flame spray system, said stationary member having a longitudinal axis and a guide element extending along and in an arcuate path at least partially about said axis;

(b) a movable member mounted to said stationary member to undergo axial movement between forward and rearward axial positions relative to said stationary member along said axis of said stationary member, said movable member having a follower element engaged with said guide element of said stationary member such that upon axial movement of said movable member between said forward and rearward axial positions, said follower element moves alone said arcuate path of said guide element in thereby causing corresponding rotational movement of said movable member between first and second rotational positions relative to said stationary member;

(c) a barrier member mounted on said movable member forwardly of said stationary member to undergo movement with said movable member, said barrier member being moved between a blocking position in which said barrier member is extended across a spray path of the flame spray gun upon axial movement of said movable member to said forward axial position and rotational movement of said movable member to said first rotational position and an unblocking position in which said barrier member is displaced from the spray path of the flame spray gun upon axial movement of said movable member to said rearward axial position and rotational movement of said movable member to said second rotational position; and (d) an actuator coupled to said movable member and being operable to cause said axial movement of said movable member between said forward and rearward axial positions relative to said stationary member.

5. The apparatus of claim 4, wherein said guide element is a slot in said stationary element.

6. The apparatus of claim 5, wherein said follower element is a protrusion on said movable element extending outwardly into said slot of said stationary element such that said axial movement of said movable member between forward and rearward axial positions causes corresponding rotational movement of said movable member between first and second rotational positions.

7. The apparatus of claim 4, wherein said barrier member is a flag.

8. The apparatus of claim 4, wherein said stationary member is an elongated hollow sleeve having a pair of opposite ends.

9. The apparatus of claim 8, wherein said movable member is an elongated support rod extending through said hollow sleeve and being greater in length than said hollow sleeve such that opposite ends of said support rod extend beyond opposite ends of said hollow sleeve.

10. The apparatus of claim 9, wherein said guide element is a slot defined in said hollow sleeve and extending along and in said arcuate path at least partially about said axis of said sleeve.

11. The apparatus of claim 10, wherein said follower element is a protrusion on said support rod extending outwardly into said slot of said sleeve such that said axial movement of said support rod between said forward and rearward axial positions causes corresponding rotational movement of said support rod between first and second rotational positions relative to said sleeve.

12. The apparatus of claim 9, wherein said actuator is coupled to said support rod rearwardly of said sleeve.

13. An automated rod delivery apparatus for a flame spray system, said apparatus comprising:

(a) a magazine having a chamber for holding a plurality of elongated rods of heat fusible material in a stacked relationship with one another, said magazine having a front opening aligned with a lowermost one of the rods of heat fusible material in said chamber of said magazine and also aligned with a feed passage through a flame spray gun leading to a combustion head in the flame spray gun wherein the rod is advanced toward the combustion head and progressively softened and atomized into particles of fusible material; and (b) a feed mechanism mounted adjacent to said magazine and adapted to be selectively actuated to successively engage and transfer the lowermost one of the rods from the stack thereof in said chamber of said magazine out through said front opening of said magazine and into the feed passage of the flame spray gun.

14. The apparatus of claim 13, wherein said magazine includes an enclosure having a stationary sidewall portion and a movable sidewall portion facing said stationary sidewall portion and being movable toward and away therefrom and therewith defining said chamber therebetween.

15. The apparatus of claim 14, wherein said magazine further includes means for adjustable moving said movable sidewall portion toward and away from said stationary sidewall portion so as to adjust said chamber in width to receive rods of different diameters therein.

16. The apparatus of claim 15, wherein said adjustable means includes at least a pair of pins movably supporting said movable sidewall portion and at least one spring-biased rotatable knob for causing movement of said movable sidewall portion on said pins upon selected rotation of said knob.

17. The apparatus of claim 13, wherein said feed mechanism includes a feed rod inserted into said chamber of said magazine through a rear opening thereof in alignment with the lowermost one of the rods of heat fusible material therein.

18. The system of claim 17, wherein said feed mechanism further includes an actuator connected to said feed rod and being operable to cause said feed rod to successively engage and transfer the lowermost one of the rods from the stack thereof in said chamber of said magazine out through said front opening of said magazine and into said feed passage of said flame spray gun.

19. The apparatus of claim 17, wherein said feed rod has a leading nose end with an inclined configuration adapting said feed rod to push forward on the lowermost one of the rods as said feed rod raises the remainder of the rods in the stack thereof upwardly out of the way of the lowermost rod.

20. A flame spray system, comprising:

(a) a flame spray gun adapted to receive a rod of heat fusible material therethrough and to progressively soften and atomize the rod into particles of fusible material and to propel the particles over a spray path from said flame spray gun to a product to be coated;

(b) means for controlling the rate of feeding of the rod of heat fusible material through said flame spray gun; and (c) a splatter blocking apparatus including:

(i) a barrier member adapted to be moved between a blocking position in which said barrier member is extended across said spray path from said flame spray gun preventing travel of particles of fusible material from said flame spray gun to the product being coated and an unblocking position in which said barrier member is displaced from said spray path of said flame spray gun permitting travel of particles of fusible material from said flame spray gun to the product being coated, and (ii) an actuation mechanism connected to said barrier member and adapted to be selectively actuated to move said barrier member between said blocking and unblocking positions in timed relationship with interruption in feeding of rods through said flame spray gun.

21. The system of claim 20, further comprising:

an automated rod delivery apparatus adapted to store a stack of rods of heat fusible material and to be selectively actuated to successively engage and transfer a lowermost one of the rods from the stack into the flame spray gun.

22. The system of claim 20, further comprising:

means for sensing an end of a rod being fed through said flame spray gun for timing the actuation of said actuation mechanism of said splatter blocking apparatus to move said barrier member between said blocking and unblocking positions.

23. The system of claim 20, wherein said actuation mechanism includes:

a stationary member mounted in a stationary position alongside said flame spray gun and having a longitudinal axis and a guide element extending along and in an arcuate path at least partially about said axis; and a movable member mounted to said stationary member to undergo axial movement between forward and rearward axial positions relative to said stationary member along said axis of said stationary member, said movable member having a follower element engaged with said guide element of said stationary member such that upon axial movement of said movable member between said forward and rearward axial positions, said follower element moves along said arcuate path of said guide element in thereby causing corresponding rotational movement of said movable member between first and second rotational positions relative to said stationary member.

24. The system of claim 23, wherein said barrier member is mounted on said movable member forwardly of said stationary member to undergo movement with said movable member, said barrier member being moved to said blocking position upon axial movement of said movable member to said forward axial position and rotational movement of said movable member to said first rotational position, said barrier member being movable to said unblocking position upon axial movement of said movable member to said rearward axial position and rotational movement of said movable member to said second rotational position.

25. The system of claim 23, wherein said actuation mechanism further includes an actuator coupled to said movable member and being operable to cause said axial movement of said movable member between said forward and rearward axial positions relative to said stationary member.

26. A flame spray system, comprising:

(a) a flame spray gun adapted to receive a rod of heat fusible material therethrough and to progressively soften and atomize the rod into fusible material particles and to propel the particles over a spray path from said flame spray gun to a product to be coated;

(b) means for controlling the rate of feeding of the rod of heat fusible material through said flame spray gun; and (c) an automated rod delivery apparatus including (i) a magazine having a chamber for holding a plurality of the rods of heat fusible material in a stacked relationship with one another, said magazine having a front opening aligned with a lowermost one of the rods of the stack in said chamber of said magazine and also aligned with a feed passage through said flame spray gun wherein the rod is advanced toward a combustion head where the rod is then progressively soften and atomized into the particles of fusible material, and (ii) a feed mechanism mounted adjacent to said magazine and adapted to be selectively actuated to successively engage and transfer the lowermost one of the rods from the stack thereof in said chamber of said magazine out through said front opening of said magazine and into said feed passage of said flame spray gun.

27. The system of claim 26, further comprising:

a splatter blocking apparatus adapted to be selectively actuated in timed relationship with interruption in feeding of rods through said flame spray gun for avoidance of splattering of particles of heat fusible material from said flame spray gun onto the product being coated.

28. The system of claim 27, further comprising:

means for sensing an end of a rod being fed through said flame spray gun for timing the actuation of said splatter blocking apparatus for avoidance of splattering of particles of heat fusible material from said flame spray gun onto the product being coated.

29. The system of claim 26, further comprising:

means for sensing an end of a rod being fed through said flame spray gun for timing the actuation of said feed actuation mechanism of said automated rod delivery apparatus to successively engage and transfer the lowermost one of the rods from the stack thereof from said chamber of said magazine out through said front opening of said magazine and into said feed passage of said flame spray gun.

30. The system of claim 26, wherein said magazine includes an enclosure having a stationary sidewall portion and a movable sidewall portion facing said stationary sidewall portion and being movable toward and away therefrom and therewith defining said chamber therebetween.

31. The system of claim 30, wherein said magazine further includes means for adjustable moving said movable sidewall portion toward and away from said stationary sidewall portion so as to adjust said chamber in width to receive rods of different diameters therein.

32. The system of claim 31, wherein said adjustable means includes at least a pair of pins movably supporting said movable sidewall portion and at least one spring-biased rotatable knob for causing movement of said movable sidewall portion on said pins upon selected rotation of said knob.

33. The system of claim 26, wherein said feed mechanism includes a feed rod inserted into said chamber of said magazine through a rear opening thereof in alignment with the lowermost one of the rods of heat fusible material therein.

34. The system of claim 33, wherein said feed mechanism further includes an actuator connected to said feed rod and being operable to cause said feed rod to successively engage and transfer the lowermost one of the rods from the stack thereof in said chamber of said magazine out through said front opening of said magazine and into said feed passage of said flame spray gun.

35. The system of claim 33, wherein said feed rod has a leading nose end with an inclined configuration adapting said feed rod to push forward on the lowermost one of the rods as said feed rod raises the remainder of the rods in the stack thereof upwardly out of the way of the lowermost rod.

* * * * *